US008869935B2

(12) United States Patent
Baglin

(10) Patent No.: US 8,869,935 B2
(45) Date of Patent: Oct. 28, 2014

(54) LADDER USAGE

(75) Inventor: Neil Ernest Baglin, Sandy (GB)

(73) Assignee: Easi-Dec Access Systems Limited, Berkshire (GB)

( * ) Notice: Subject to any disclaimer, the term of this patent is extended or adjusted under 35 U.S.C. 154(b) by 305 days.

(21) Appl. No.: 13/384,466

(22) PCT Filed: Jul. 14, 2010

(86) PCT No.: PCT/GB2010/001339

§ 371 (c)(1),
(2), (4) Date: Mar. 12, 2012

(87) PCT Pub. No.: WO2011/007134

PCT Pub. Date: Jan. 20, 2011

(65) Prior Publication Data

US 2012/0168250 A1 Jul. 5, 2012

(30) Foreign Application Priority Data

Jul. 16, 2009 (GB) ..... 0912330.8

(51) Int. Cl.
*E06C 7/16* (2006.01)
*E06C 7/18* (2006.01)
*E06C 7/48* (2006.01)

(52) U.S. Cl.
CPC . *E06C 7/16* (2013.01); *E06C 7/185* (2013.01); *E06C 7/48* (2013.01)
USPC ..... 182/116; 182/113

(58) Field of Classification Search
USPC ..... 182/113, 116, 200, 201, 214
See application file for complete search history.

(56) References Cited

U.S. PATENT DOCUMENTS

| | | | | | |
|---|---|---|---|---|---|
| 221,401 | A | * | 11/1879 | Drake et al. | 182/52 |
| 2,035,537 | A | * | 3/1936 | Cowan et al. | 182/39 |
| 2,198,071 | A | | 4/1940 | Artini | |
| 2,597,902 | A | * | 5/1952 | Roketa | 182/214 |

(Continued)

FOREIGN PATENT DOCUMENTS

| | | | |
|---|---|---|---|
| CA | 2305199 | A1 | 4/1999 |
| DE | 102007058761 | A1 | 6/2009 |

(Continued)

OTHER PUBLICATIONS

GB Search Report, dated Nov. 12, 2010, from corresponding GB application.

(Continued)

*Primary Examiner* — Alvin Chin-Shue
*Assistant Examiner* — Colleen M Chavchavadze
(74) *Attorney, Agent, or Firm* — Young & Thompson

(57) ABSTRACT

A work platform unit (1) mountable to a ladder (3) the unit including a platform (2) upon which a work person may stand and which is adapted for mounting to the upper end of the ladder (3) such that when the ladder is located in a position of use the platform (2) may be set to a horizontal position, and a safety barrier construction for providing all round safety protection to a person when standing upon the platform, the safety barrier construction involving a framework (22) upstanding from the perimeter region of the platform (2) and incorporating a gate arrangements (42,43) such that when closed the framework (22) effectively totally surrounds a person when present upon the platform (2) to provide said all round protection.

11 Claims, 3 Drawing Sheets

(56) References Cited

U.S. PATENT DOCUMENTS

| | | | | |
|---|---|---|---|---|
| 2,732,264 | A | 1/1956 | Smith et al. | |
| 2,881,028 | A | 4/1959 | Baird | |
| 3,664,458 | A * | 5/1972 | Sterns et al. | 182/102 |
| 4,185,716 | A * | 1/1980 | Rinehart | 182/2.5 |
| 4,263,984 | A * | 4/1981 | Masuda et al. | 182/113 |
| 4,394,887 | A * | 7/1983 | Spinks | 182/214 |
| 5,069,309 | A * | 12/1991 | Swiderski et al. | 182/119 |
| 5,203,425 | A * | 4/1993 | Wehmeyer | 182/19 |
| 5,588,500 | A * | 12/1996 | Yonahara | 182/141 |
| 5,634,529 | A * | 6/1997 | Nguyen et al. | 182/113 |
| 6,145,619 | A * | 11/2000 | Risser | 182/113 |
| 6,174,124 | B1 * | 1/2001 | Haverfield et al. | 414/642 |
| 6,250,424 | B1 * | 6/2001 | Laug | 182/107 |
| 6,471,004 | B2 * | 10/2002 | Stringer et al. | 182/148 |
| 6,863,155 | B2 * | 3/2005 | Wyse et al. | 182/118 |
| 6,883,670 | B2 * | 4/2005 | Moon | 211/74 |
| 6,929,095 | B2 * | 8/2005 | Brygger | 182/107 |
| 7,228,936 | B2 * | 6/2007 | Wyse et al. | 182/17 |
| 8,251,180 | B1 * | 8/2012 | Paige | 182/107 |
| 8,292,039 | B2 * | 10/2012 | Campbell et al. | 187/261 |
| 8,590,921 | B2 * | 11/2013 | Benson et al. | 280/656 |
| 2002/0074186 | A1 * | 6/2002 | Baldas et al. | 182/69.6 |
| 2005/0189173 | A1 * | 9/2005 | Becker | 182/113 |
| 2007/0278041 | A1 * | 12/2007 | Cosgrove | 182/113 |
| 2012/0168249 | A1 * | 7/2012 | Furseth et al. | 182/113 |

FOREIGN PATENT DOCUMENTS

| | | | |
|---|---|---|---|
| EP | 2388431 | A1 | 11/2011 |
| FR | 806 801 | A | 12/1936 |
| FR | 2447453 | A1 | 8/1980 |
| FR | 2793519 | A1 | 11/2000 |
| FR | 2 799 501 | A1 | 4/2001 |
| GB | 2 471 947 | A | 1/2011 |
| NL | 9001054 | A | 12/1991 |

OTHER PUBLICATIONS

UK Office Action, dated Jun. 14, 2013, from corresponding UK application.

International Search Report, dated Jun. 17, 2011, from corresponding PCT application.

* cited by examiner

LADDER USAGE

This invention relates to the use of ladders by persons who require to carry out an action, operation, task or the like at elevated levels.

It is an extremely common practice for work persons who require to carry out activities at elevated levels to consider that their intended activities do not necessitate the erection of scaffolding arrangements since they require time and effort for their erection. In such situations work persons resort to the use of a ladder provided that the action, operation or task required to be carried out is at a height reachable whilst standing upon a ladder. Above such a height scaffolding or other arrangements other than ladders have to be involved The usage of ladders at lower levels effectively ignores the loss of perhaps the most important advantage arising from the usage of scaffolding since the latter provides work persons with a secure spacious platform upon which to work as well as enabling such work persons to be able easily to work under what may be regarded as hands free conditions in the sense that a work person needs always to be holding onto a support for safety reasons.

In practice, in relation to ladder usage it is frequently the case that a work person does not pay attention to ensure that he is securely positioned and balanced upon the ladder i.e., at all times standing on both feet and holding on with one hand to the ladder.

As will be appreciated this clearly essential requirement for ensuring secure positioning and balance imposes severe limitations upon the activities of a work persons using a ladder.

A further common underlying reason for the use of a ladder resides in the fact that ladders are readily transportable by relatively small sized vehicles such as, for example, cars provided with appropriate roof racks, short length vans provided with ladder mounting supports as compared with very much larger vehicles i.e., lorries that are inevitably necessary for the transportation of scaffolding systems.

As a consequence of the extremely varied forms of ladder usage whilst possibly not maintaining the requisite user balance whilst working it will be appreciated that the use of a ladder inherently involves the risk of accidents arising whenever a work person over-reaches whilst working. Such a situation often arises when a work person merely wishes to avoid the effort involved in moving a ladder to a more suitable position with respect to a required work area.

Since it is thus well known that the use of a ladder frequently leads to accidents to work persons more and more health and safety regulations have in recent times been progressively introduced with a view to eliminating where feasible improper usage of a ladder and thus reduce risk of accidents at a work place.

Unfortunately in spite of the ongoing exhortations by the authorities to avoid the improper usage of ladders many work persons for reasons such as above mentioned prefer to use ladders whilst for various reasons fail to take the precautions advocated either through lack of knowledge or more regrettably as a result of a deliberate choice of choosing to ignore the regulations.

Often in the case of the latter situation an underlying reason appears to reside in the fact that such persons have not equipped themselves with devices associated with ladder safety or just do not bother to use them even where they are available.

It is an object of the present invention to facilitate safer use of a ladder.

Broadly according to a first aspect of the invention there is provided a work platform unit mountable to a ladder including a platform upon which a work person may stand adapted for mounting to the end of a ladder such that when the ladder is located in a position of use the platform may be set to a horizontal position, and a safety barrier construction for providing all round safety protection to a person when standing upon the platform.

Preferably the safety barrier construction includes a framework upstanding from the perimeter region of the platform and incorporating a gate arrangements such that when closed the framework effectively totally surrounds a person when present upon the platform to provide said all round protection.

Also preferably the work platform unit includes means adapted for releasable engagement with the ends of styles of the ladder upon which the unit is to be mounted, and means for maintaining the platform in a required operational position relative to the associated end of the ladder.

In particular the means for enabling releasable engagement with the ends of the ladder styles includes socket members engageable with the ends of the ladder styles, and means for retaining the sockets in their engaged positions with the ends of the ladder styles.

Conveniently the means for retaining the sockets in their engaged positions with the ends of the styles includes for each such style a locking pin engageable with bores provided in the style end and the associated socket together with means for preventing movement between a socket and its associated style and the means for preventing movement includes a thumb screw engageable with a threaded bore in the socket such that when tightened can exert cramping pressure on the style.

In a preferred construction the means for maintaining the platform in a required operational position relative to the associated end of the ladder includes to each side of the platform a support strip/strut pivotally connected to the adjacent side of the platform and adapted for connection to the associated ladder style when the platform is set to its required operational position relative to the ladder.

Conveniently the platform is provided at the end region thereof remote from the connection sockets with wheels so positioned as to be able engage with a surface against which the ladder is to rest in such manner as to facilitate the raising and lowering of the ladder whilst the upper part of the safety framework is provided with further wheels so positioned as to be able to engage with a surface against which the ladder is to rest in such manner as to facilitate the raising and lowering of the ladder.

In a further particular construction the safety barrier construction framework includes a first pair of upright members upstanding from the corners of the platform remote from the region of the platform associated with said sockets, an upper rail interconnecting the tops of the uprights, an intermediate rail interconnecting the upright members intermediate the top and bottom thereof, said rails and the uprights defining a rectangular sub-frame facing towards any support against which the ladder rests when in use, curved tubular upper and intermediate rail extending from the free end regions of each of said upper and intermediate rails, upright members interconnecting the free end regions of the upper and intermediate tubular rails and outwards leaning further upright members for supporting the free end regions of the intermediate tubular rails with respect to the platform, the arrangement being such that the tubular rails and their associated uprights define a part cylindrical framework having a diameter greater than the width of the platform.

Conveniently the gate arrangement includes a gate member for each side of the platform with each said gate member including upper and lower curved rails that are slidably engageable in the upper and intermediate tubular rails and a vertical member interconnecting the exposed free ends of the curved rails, the arrangement being such that when said vertical members are located side by side the gate members combine to provide a part cylindrical closure to the gate arrangement.

Also means are provided for enabling a work person when standing on the platform to lock the two gate members together.

For a better understanding of the invention and to show how to carry the same into effect reference will now be made to the accompanying drawings in which:—

FIG. 1 schematically illustrates in side view an embodiment of a work platform unit when mounted to the upper end of a support such as a ladder;

Figure 1:
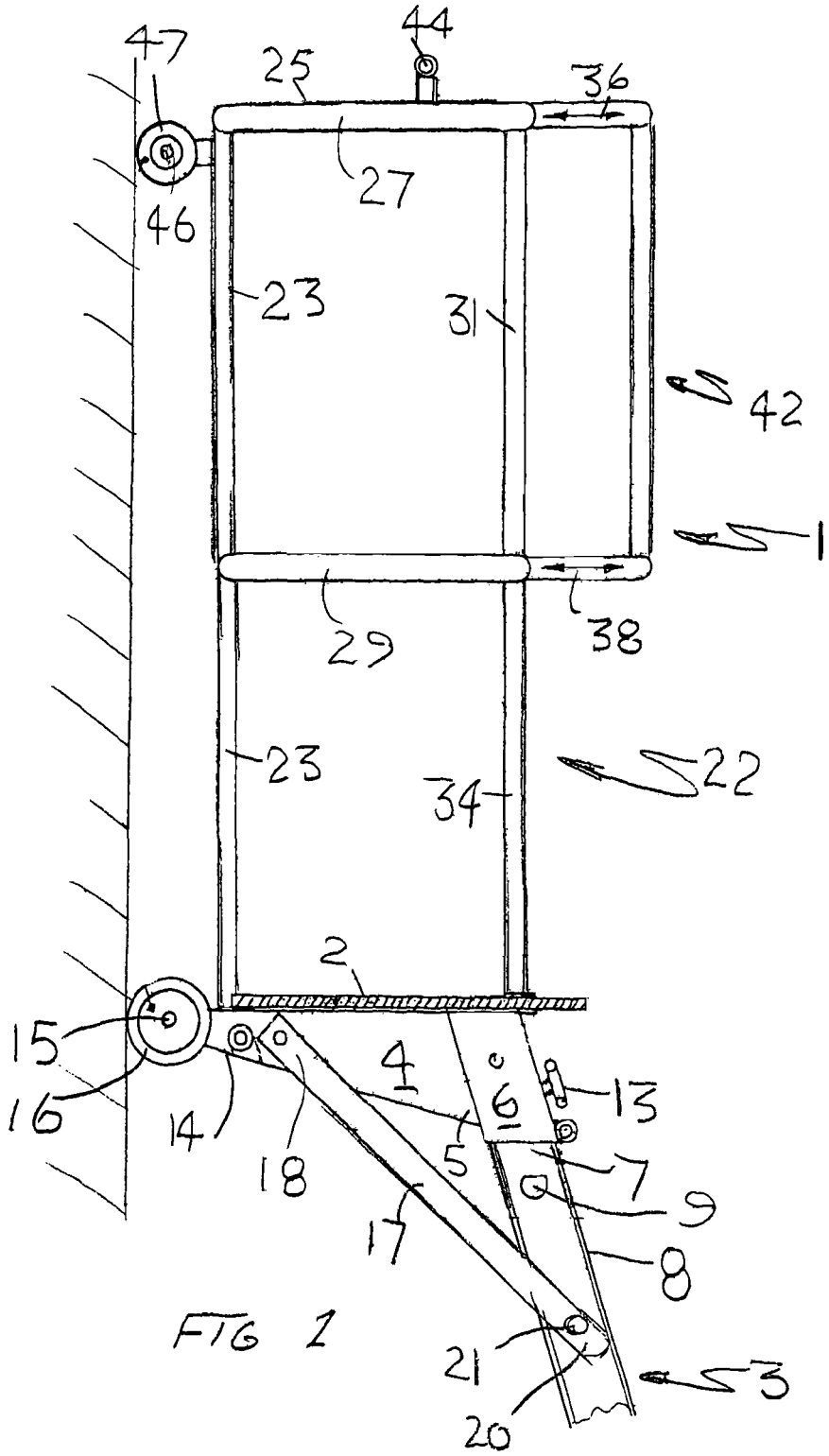

Referring now to the drawings a ladder user work platform unit 1 shown therein includes a platform/base 2 upon which it is intended that a user of a ladder 3 to which the unit 1 is mounted will be able to stand and work.

Each side of the platform 2 is mounted upon a main support rail 4 of which one end 5 of each is provided with a tubular socket 6 that is shaped so as to be engageable with the upper end 7 of a style 8 of the ladder 3. As is conventional the ladder includes a number of rungs 9 interconnecting the styles 8. The upper end 7 of each style 8 is provided with a socket location block (not separately shown) that is mounted to the upper end of the front face of each style 8, these blocks providing additional stiffness between the associated style end 7 and the socket 6.

Each socket 6 is retained in position upon its associated ladder style end 7 by means of a locking pin 10 that is locatable in a hole provided in the ladder style end 7. In addition, each socket 6 is provided with a resilient clamping bar 11 slightly angularly upstanding from the front face 12 of the socket. This bar 11 has a bore which enables a hand rotatable thumb screw 13 which threadably engages with a threaded bore provided in said front face 12 to enable the free end of the thumb screw 13 to abut the ladder style end 7. With this arrangement the socket 6 can be effectively cramped to the ladder style end upon tightening the thumb screw 13. It will be understood that on tightening the thumb screw 13 its engagement with the clamping bar 11 produces a locking action engagement with the main part of the socket 6 which is thus effectively clamped in its required position and which offsets loosening of the thumb screw 13.

The other ends 14 (the ends that will be nearest to any surface against which the ladder is arranged) of the side rails 4 are provided with supports 15 that project forwardly of the ends 14 to provide mountings for axles 15 for the wheels 16 which are intended to engage with and run along any surface against which the ladder is required to rest particularly during the raising and lowering of the ladder.

Each side rail 4 is braced into its required setting relative to the ladder 3 by bracing struts 17 pivotally mounted at one end 18 thereof to the associated side rail 4 by means of a locking pin 19. The other end 20 of each bracing strut 17 is secured by a locking pin 21 to the associated ladder style 8 at a location such that when the ladder is upstanding at the generally used ladder inclination angle the platform 2 will be horizontal.

A user safety framework 22 is provided above the platform 2. The framework being effectively supported by the side rails 4. This framework 22 includes two vertical main front members 23 upstanding from the ends 14 of the rails associated with the wheels 16.

The uppermost ends 24 of the main members 23 are bridged by a top straight rail 25 that extends for the full width of the platform 2.

The members 23 and the top rail 25 effectively define the operative height of the safety framework 22 which height is in practice at least effectively the waist height of a person of average height. In addition, an intermediate straight rail 26 bridges the main members 23 midway of the height thereof so that the main members 23 are thus braced relative to each other intermediate of the length thereof and also at the top thereof.

One end of the upper straight rail 25 is connected to the end 27A of a tubular curved rail 27 and the other end of the upper straight rail 25 is connected to the end 28A of a second tubular curved rail 28. Similarly one end of the intermediate straight rail 26 is connected to the end 29A of a tubular curved rail 29 and the other end of the intermediate straight rail 26 is connected to the end 30A of a second tubular curved rail 30.

These upper and intermediate tubular side rails 27, 28, 29 and 30 effectively provide the side members to the user safety framework 22

The free ends of the curved rails 27 and 29 are interconnected by a vertical main member 31 whilst the free ends of the curved rails 28 and 30 by a second vertical main member 32.

The curvature of the curved rails 27, 28, 29 and 30 are such that the main members 31 and 32 are located outwardly of the width of the platform 2.

The free ends 29B and 30B of the tubular curved rails 29 and 30 are supported with respect to the platform 2 by upright main rails 33 and 34 which are inclined inwards from the curved rail ends 29B and 30B and whose lower ends are connected with the support platform and its supporting struts.

The tubular side members 27,28,29 and 30 are hollow and serve telescopically slidably to receive similarly shaped curved slide members 36,37,38, and 39 respectively. A vertical frame member 40 interconnects the free ends of the slide members 36 and 38 and a vertical frame member 41 interconnects the free ends of the slide members 37 and 39. respectively to each side of the framework 22 are connected to an upright frame member 34.

Figure 2:
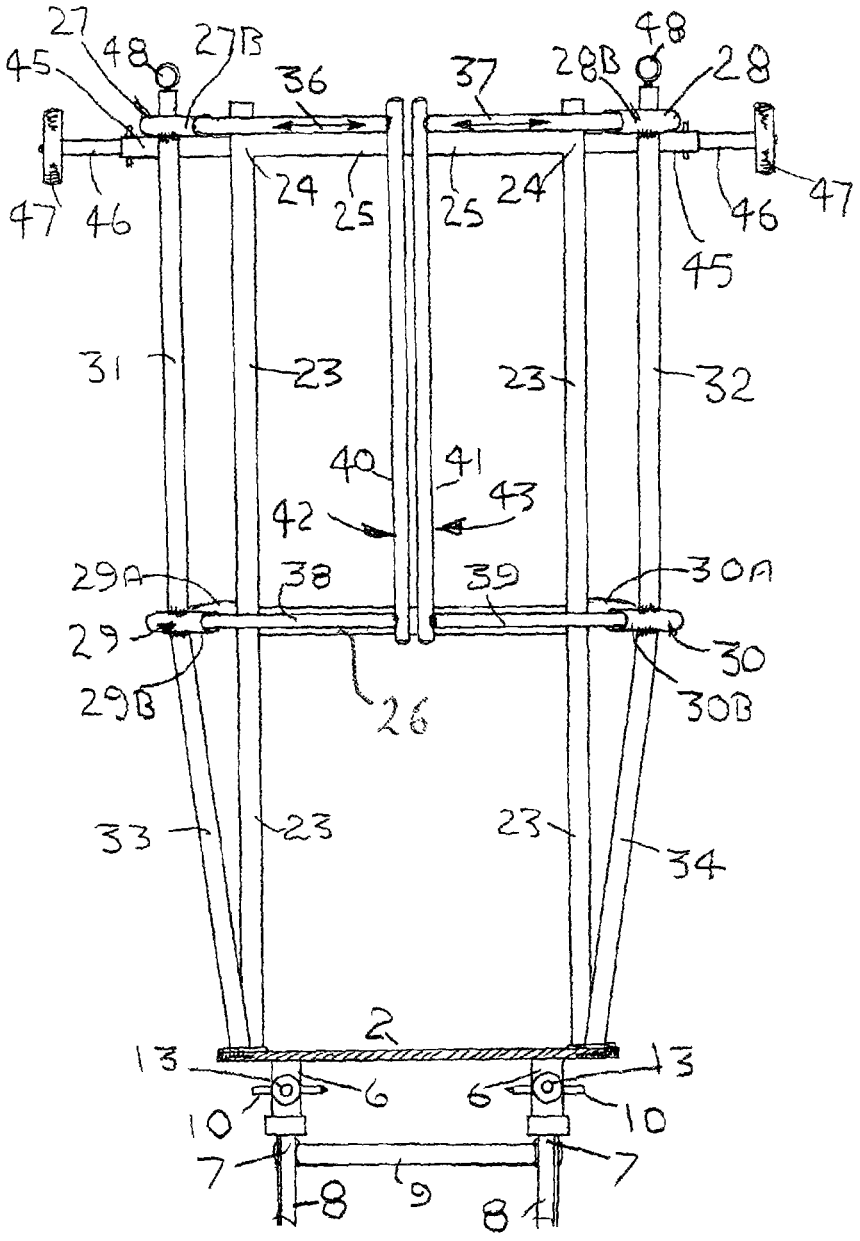
FIG. 2 is an end view of the rear of the platform unit of FIG. 1.
Figure 3:
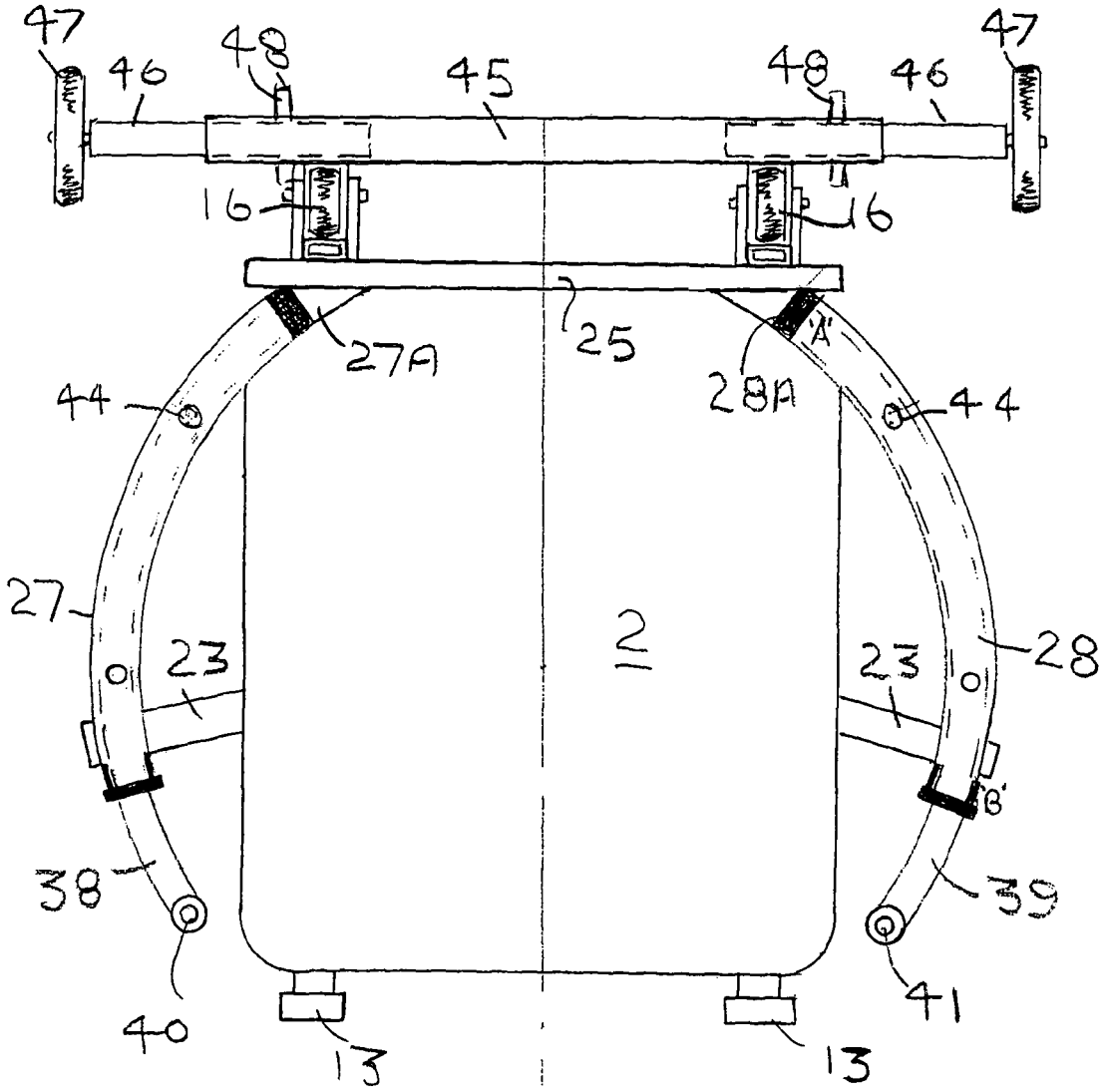
FIG. 3 is a plan view of the platform unit of FIG. 1.

This construction effectively provides two gate forming structures 42 and 43 that are movable between an open position such as is shown in FIG. 3 in which the curved slide members and the associated uprights do not overlay the platform and a closed position in which the uprights are close together as shown in FIG. 2.

It will thus be apparent that the construction of the gate forming structures 42,43 are such that when they are in the closed positions as shown in FIG. 2 a work person standing upon the platform is effectively totally surrounded by the above described framework 22 and that when the gate structures 42,43 are in their open positions as shown in FIG. 3 a work person is able to enter and leave the platform 2.

Each of the upper curved rails 27 and 28 is provided with a resiliently loaded locking pin 44 that is resiliently loaded towards a position in which it is able to engage in a bore provided in the associated slide member 36, 37 when the latter have been moved to their closed positions.

With this arrangement the two gate structures 42,43 can be locked together whilst in the positions as shown in FIG. 2. Because of their curvature they effectively provide a generally cylindrical shape to the user safety framework 22.

The upper cross rail 25 is used to enable the mounting of a support bar 45 for the axles 46 of a further pair of wheels 47 whose purpose is to facilitate the raising and lowering of the ladder 3 with respect to a surface/wall 48 upon which the upper end of the ladder 3 is required to rest when in use. The axles 46 telescopically engage with the associated support bar 45. The axles 46 are thus displaceable between a stowed position and an extended use position as shown in FIG. 2. The axles are retainable in the extended use position by locking pins 49.

When the platform 2 is required for use with a ladder the platform unit 1 is mounted to the upper end 7 of the ladder 3 by engaging the sockets 6 with the upper end 7 of the ladder. Each locking pin 10 is then inserted and the thumb screws 13 are tightened. In addition, the free ends 20 of the bracing struts 17 are attached to the associated style 8 of the ladder using the locking pins 21 associated therewith.

The upper pair of wheels 47 are pulled outwards to their extended positions and locked in place with the locking pins 48.

The ladder with the attached unit 1 is then raised by initially running the upper pair of wheels 47 against the wall 48 whilst at the same time advancing the ladder towards the wall or like surface 48 until the lower pair of wheels 16 are able move into rolling contact with the wall 48. Once the ladder has been raised its working inclination is adjusted so that it is set at the requisite inclination required to set the platform 2 into a required horizontal setting. The bottom of the ladder is the effectively secured against displacement by actuating and associated stabiliser and ladder levelling elements (not shown) associated with the ladder.

Once this has been carried out a person who wishes to work from the ladder can then mount the ladder step onto the support platform, move the gate structures 42,43 to their closed positions as shown in FIG. 2 and to then lock the gates structures in their closed positions by means of the locking pins 44 care being taken to ensure that the gate structures are correctly locked in their closed positions by the locking pins.

When it is required to descend the ladder the gate structures locking pins 44 are released to allow gate opening and the gate structures are moved to their open settings as shown in FIG. 3. The work person is then able to demount from the assembly/unit.

The invention claimed is:

1. A work platform unit mountable to a ladder, comprising:

a platform upon which a work person may stand, the platform mountable to an end of a ladder such that when the ladder is located in a position of use the platform is settable to a horizontal position, and a safety barrier construction located above the platform, the safety barrier construction providing all around safety protection to the work person when standing upon the platform, wherein said platform includes socket members engagable with upper ends of each stile of the ladder, wherein the safety barrier construction framework includes an arrangement comprised of i) a first pair of upright members upstanding from corners of the platform remote from a region of the platform associated with said sockets, ii) an upper rail interconnecting tops of the upright members, iii) an intermediate rail interconnecting the upright members intermediate the top and bottom thereof, said upper and intermediate rails and the upright members defining a rectangular sub-frame facing towards any support against which the ladder rests when in use, iv) a curved tubular upper rail and intermediate rail extending from free end regions of each of said upper and intermediate rails, the upright members interconnecting the free end regions of the upper and intermediate tubular rails, and v) outwards leaning further upright members supporting the free end regions of the intermediate tubular rails with respect to the platform, the arrangement being such that the tubular rails and the associated upright members define a partially cylindrical framework having a diameter greater than the width of the platform, wherein the safety barrier construction incorporates a gate arrangement such that with the gate arrangement closed, the framework effectively totally surrounds the work person when present upon the platform thereby to provide said all around protection, and wherein the gate arrangement includes a respective gate member for each side of the platform with each said gate member including i) upper and lower curved rails that are respectively slidably engageable in the upper and intermediate tubular rails and ii) a vertical member interconnecting exposed free ends of the upper and lower curved rails, the gate arrangement being such that when said vertical member of each gate member are located side by side, the gate members combine to provide a partially cylindrical closure to the gate arrangement.

2. A work platform unit as claimed in claim 1, wherein the socket members are releasably engageable with the upper ends of each stile and a locking element locks the socket members to the upper ends of each stile.

3. A work platform unit as claimed in claim 2, wherein, the locking element is a locking pin engageable with bores in an end of each stile and the associated socket, the locking pin locking the bore and associated socket together, and further comprising a part preventing movement between the socket and the associated stile.

4. A work platform unit as claimed in claim 3, wherein, each socket includes a threaded bore, and the part preventing movement includes a thumb screw engageable with the threaded bore in the socket such that when the thumb screw is tightened, a free end of the thumb screw exerts a clamping pressure on the stile.

5. A work platform unit as claimed in claim 1, wherein each side of the platform includes a side rail provided with forwardly projecting support that maintains the platform in a required operational position relative to an associated end of the ladder, each side rail is further provided with a pivotable connected strut, each strut connectable to an associated stile of the ladder.

6. A work platform unit as claimed in claim 5, wherein the forwardly projecting support includes a wheel positioned as engage with a surface against which the ladder is to rest in such manner as to facilitate raising and lowering of the ladder.

7. A work platform unit as claimed in claim 1, wherein an upper part of the safety framework is provided with wheels that are capable of engaging with a surface against which the ladder is to rest in such manner as to facilitate raising and lowering of the ladder.

8. A work platform unit as claimed in claim 1, and wherein the gate members lock together.

9. A work platform unit mountable to a ladder, comprising:

a platform upon which a work person may stand, the platform mountable to an end of a ladder such that when the ladder is located in a position of use the platform is settable to a horizontal position, and a safety barrier construction located above the platform, the safety barrier construction providing all around safety protection to the work person when standing upon the platform, wherein said platform includes socket members releasably engagable with upper ends of each stile of the ladder, each socket including a threaded bore, and a locking pin that locks the socket members to the upper ends of each stile, the locking pin engageable with bores in an end of each stile and the threaded bore of the associated socket, the locking pin locking the bore and associated socket together, wherein the locking pin comprising a part preventing movement between the socket and the associated stile, the part preventing movement including a thumb screw engageable with the threaded bore in the socket such that when the thumb screw is tightened, a free end of the thumb screw exerts a clamping pressure on the stile, wherein the safety barrier construction framework includes an arrangement comprised of i) a first pair of upright members upstanding from corners of the platform remote from a region of the platform associated with said sockets, ii) an upper rail interconnecting tops of the upright members, iii) an intermediate rail interconnecting the upright members intermediate the top and bottom thereof, said upper and intermediate rails and the upright members defining a rectangular sub-frame facing towards any support against which the ladder rests when in use, iv) a curved tubular upper rail and intermediate rail extending from free end regions of each of said upper and intermediate rails, the upright members interconnecting the free end regions of the upper and intermediate tubular rails, and v) outwards leaning further upright members supporting the free end regions of the intermediate tubular rails with respect to the platform, the arrangement being such that the tubular rails and the associated upright members define a partially cylindrical framework having a diameter greater than the width of the platform.

10. A work platform unit mountable to a ladder, comprising:

a platform upon which a work person may stand, the platform mountable to an end of a ladder such that when the ladder is located in a position of use the platform is settable to a horizontal position, and a safety barrier construction located above the platform, the safety barrier construction providing all around safety protection to the work person when standing upon the platform, wherein said platform includes socket members releasably engagable with upper ends of each stile of the ladder, each socket including a threaded bore, and a locking pin that locks the socket members to the upper ends of each stile, the locking pin engageable with bores in an end of each stile and the threaded bore of the associated socket, the locking pin locking the bore and associated socket together, wherein the locking pin comprising a part preventing movement between the socket and the associated stile, the part preventing movement including a thumb screw engageable with the threaded bore in the socket such that when the thumb screw is tightened, a free end of the thumb screw exerts a clamping pressure on the stile, wherein each side of the platform includes a side rail provided with forwardly projecting support that maintains the platform in a required operational position relative to an associated end of the ladder, wherein each side rail is further provided with a pivotable connected strut, each strut connectable to an associated stile of the ladder, wherein the forwardly projecting support includes a wheel positioned as engage with a surface against which the ladder is to rest in such manner as to facilitate raising and lowering of the ladder, wherein an upper part of the safety framework is provided with wheels that engage with a surface against which the ladder is to rest in such manner as to facilitate raising and lowering of the ladder, wherein the safety barrier construction includes a gate arrangement such that with the gate arrangement closed, the framework effectively totally surrounds the work person present upon the platform, and wherein the gate arrangement includes two gate members respectively for each side of the platform, each said gate member including i) upper and lower curved rails that are respectively slidably engageable in the upper and intermediate tubular rails and ii) a vertical member interconnecting exposed free ends of the upper and lower curved rails, the gate arrangement being such that when said vertical member of each of the two gate members are located side by side, the gate members combine to provide a partially cylindrical closure to the gate arrangement.

11. A work platform unit as claimed in claim 10, wherein, said two gate members lock together.

* * * * *